US011377852B1

(12) United States Patent
Cotton

(10) Patent No.: US 11,377,852 B1
(45) Date of Patent: Jul. 5, 2022

(54) EMBED APPARATUS

(71) Applicant: David Cotton, Gretna, NE (US)

(72) Inventor: David Cotton, Gretna, NE (US)

( * ) Notice: Subject to any disclaimer, the term of this patent is extended or adjusted under 35 U.S.C. 154(b) by 0 days.

(21) Appl. No.: 16/684,306

(22) Filed: Nov. 14, 2019

Related U.S. Application Data

(60) Provisional application No. 62/767,350, filed on Nov. 14, 2018.

(51) Int. Cl.

| | |
|---|---|
| ***E04C 5/08*** | (2006.01) |
| ***E04C 3/293*** | (2006.01) |
| *G09F 23/00* | (2006.01) |
| *E04C 5/01* | (2006.01) |

(52) U.S. Cl.
CPC ..... *E04C 3/293* (2013.01); *E04C 5/01* (2013.01); *G09F 23/00* (2013.01)

(58) Field of Classification Search
CPC ..... E04C 3/293; E04C 5/01; G09F 23/00
See application file for complete search history.

(56) References Cited

U.S. PATENT DOCUMENTS 1,412,504 A * 4/1922 Byrne ..... E01C 5/00 404/20
1,957,176 A * 5/1934 Kotrbaty ..... E04C 3/293 52/261
2,485,165 A * 10/1949 Pollman ..... E04G 1/152 182/223
3,196,763 A * 7/1965 Rushton ..... E04C 2/427 404/21
3,343,320 A * 9/1967 Krajcinovic ..... E04C 3/294 52/252
3,398,498 A * 8/1968 Krauss ..... E04C 3/293 52/691
3,841,597 A * 10/1974 Butts ..... E04G 11/40 249/30
4,409,764 A * 10/1983 Wilnau ..... E04B 1/165 52/127.3
4,527,372 A * 7/1985 Ryan ..... E04B 5/40 52/334
4,653,237 A * 3/1987 Taft ..... E04B 5/40 52/334
5,509,243 A * 4/1996 Bettigole ..... E01D 19/125 52/334

(Continued)

OTHER PUBLICATIONS

J & G Diversified, Inc., "Metal Letters Embedded in Concrete", https://www.cut-metal-letters.com/metal-letters-embedded-in-concrete.html, Apr. 14, 2020, 4 pages.

(Continued)

*Primary Examiner* — Basil S Katcheves
(74) *Attorney, Agent, or Firm* — Suiter Swantz pc llo

(57) ABSTRACT

The present disclosure is directed to an apparatus embeddable in a surface. Such surfaces may be formed from any material known in the art of construction, such as, but not limited to, concrete, asphalt, composite rubber, or mud. The apparatus may include a graphical element for display. The apparatus may include frames supporting the graphical element. The frames may include trusses disposed between and upper and a lower surface of the frames. The frame may further include one or more tabs at the upper surface to provide clearance between the upper surface and the graphic element.

16 Claims, 15 Drawing Sheets

(56) References Cited

U.S. PATENT DOCUMENTS

| | | | | |
|---|---|---|---|---|
| 5,775,835 | A * | 7/1998 | Szekely | E01C 5/20 404/34 |
| 6,718,714 | B1 * | 4/2004 | Montgomery, Sr. | F24D 13/022 52/392 |
| 8,782,993 | B2 * | 7/2014 | Lawley | E04B 5/12 52/655.1 |
| 8,910,450 | B2 * | 12/2014 | Simon-Dominguez | E04G 11/44 52/742.14 |
| 9,398,996 | B2 * | 7/2016 | Sippola | A61H 3/066 |
| 2003/0182883 | A1 * | 10/2003 | Won | E01D 2/02 52/223.8 |
| 2012/0247055 | A1 * | 10/2012 | Lawley | E04B 1/043 52/655.1 |

OTHER PUBLICATIONS

Embedded metal letters into concrete: a how to article, "Embedded Sign Letters in Concrete", https://www.signlettersource.com/blog/embedding-sign-letters-in-concrete.php, Apr. 14, 2020, 3 pages.

* cited by examiner

EMBED APPARATUS

CROSS-REFERENCE TO RELATED APPLICATION

The present application claims the benefit under 35 U.S.C. § 119(e) of U.S. Provisional Application Ser. No. 62/767,350, filed Nov. 14, 2018, entitled EMBED APPARATUS, naming David Cotton as inventor, which is incorporated herein by reference in the entirety.

TECHNICAL FIELD

The present disclosure generally relates to the field of embed devices, and, more particularly, to an apparatus for embedding graphic elements into a surface.

BACKGROUND

Composite materials have long been used for the construction of roads and walkways. One example of this is concrete, which is a composite material including a cement binder and various aggregates. Such concrete is a prolific building material and, in some cases, may be used in aesthetic designs. The concrete may further include reinforcing materials, such as rebar, to improve durability. Before concrete hardens, the concrete is held in a slurry, which may feature properties similar to fluid, which may be difficult to work with. Placement of design elements in concrete is difficult due to the fluid nature of the liquid concrete. Therefore, it would be advantageous to provide a system and method that cures the shortcomings described above.

SUMMARY

An apparatus is disclosed in accordance with one or more illustrative embodiments of the present disclosure. In one illustrative embodiment, the apparatus includes a graphical element. In another illustrative embodiment, the apparatus includes a plurality of frames, where each of the plurality of frames includes an upper frame portion, a lower frame portion, and a plurality of truss members. In another illustrative embodiment, the plurality of truss members are disposed between and attach the lower frame portion to the upper frame portion. In another illustrative embodiment, the graphical element is attached to each of the plurality of frames. In another illustrative embodiment, the apparatus includes a plurality of struts disposed between and connecting the plurality of frames.

BRIEF DESCRIPTION OF THE DRAWINGS

The numerous advantages of the disclosure may be better understood by those skilled in the art by reference to the accompanying figures in which:

FIG. 1I illustrates a top view of the embed apparatus embedded in a material, in accordance with one or more embodiments of the present disclosure;

DETAILED DESCRIPTION OF THE INVENTION

Figure 1A:
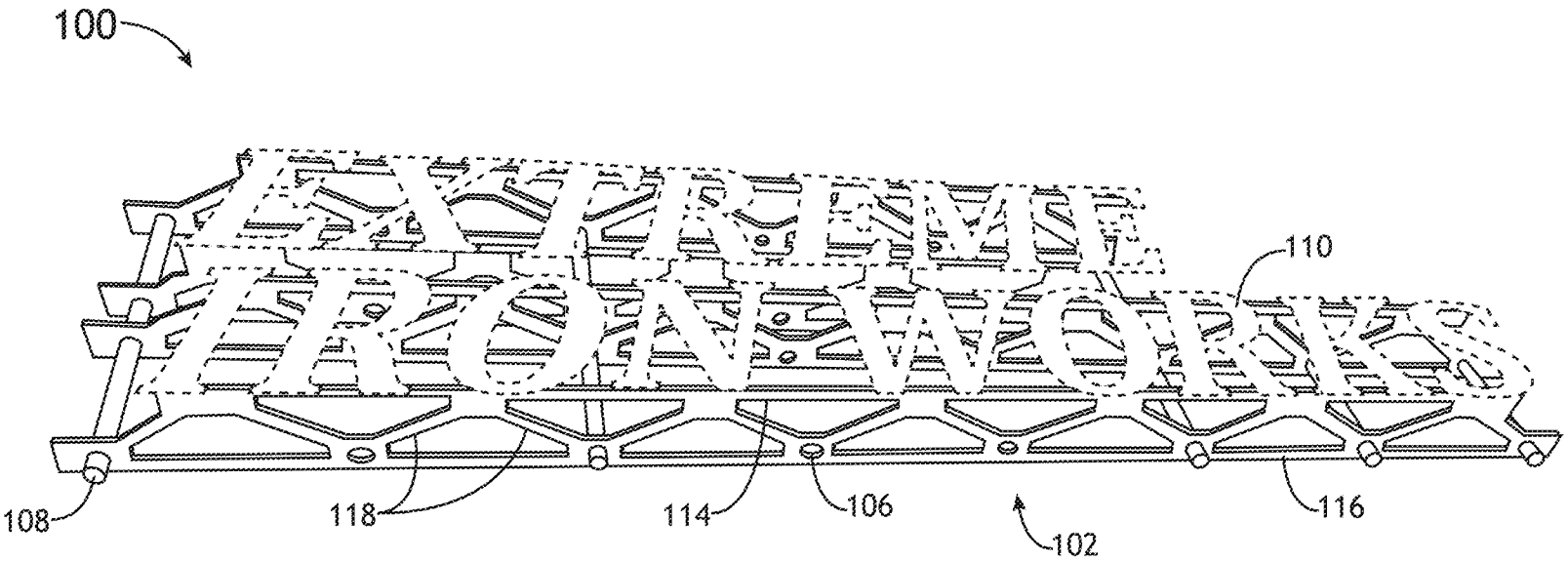
FIG. 1A illustrates a top perspective view of an embed apparatus, in accordance with one or more embodiments of the present disclosure.

Reference will now be made in detail to the subject matter disclosed, which is illustrated in the accompanying drawings.

FIGS. 1A through 2H generally illustrate an embed apparatus, in accordance with one or more embodiments of the present disclosure.

Embodiments of the present disclosure are directed to an apparatus embeddable in a surface. Such surfaces may be formed from any material known in the art of construction, such as, but not limited to, concrete, asphalt, composite rubber, or mud.

Referring now to FIGS. 1A through 1I, an apparatus 100 is shown, in accordance with one or more embodiments of the present disclosure.

In some embodiments, the apparatus includes a graphic element 110. The graphic element 110 may be affixed to the apparatus 100 using any technique known in the art. For example, the graphic element 110 may be affixed using a thermal joining technique (e.g., welding, brazing, or soldering) or mechanical fastening hardware.

In some embodiments, the graphic element 110 is attached to one or more frames 102. It is to be understood that the one or more frames 102 may comprise any number of frames, such as, but not limited to, a first frame 102*a* and a second frame 102*b*. In this regard, the number of frames 102 is not intended as a limitation on the present disclosure. Furthermore, it is noted herein that the one or more graphic elements 110 may be affixed to any portion of the frame 102. Therefore, the above description should not be interpreted as a limitation on the present disclosure but merely an illustration.

Figure 1B:
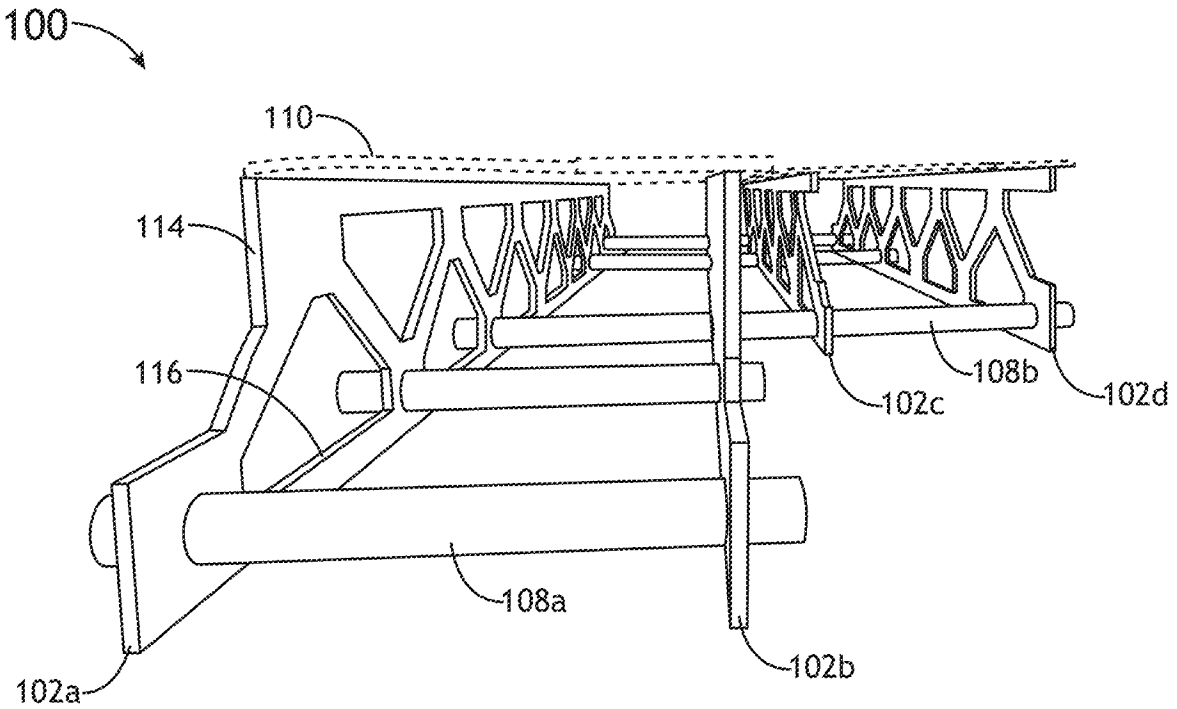
FIG. 1B illustrates an end view of the embed apparatus, in accordance with one or more embodiments of the present disclosure.
Figure 1C:
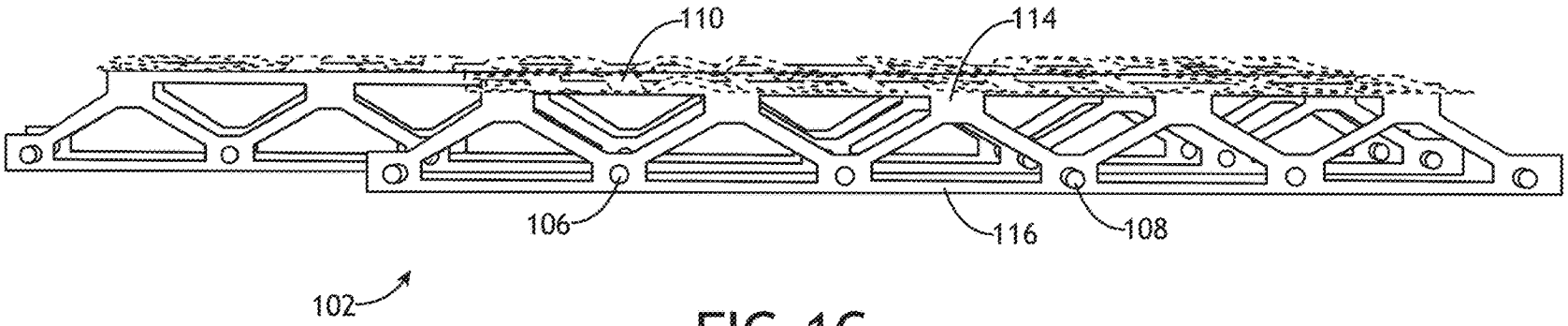
FIG. 1C illustrates a side top view of the embed apparatus, in accordance with one or more embodiments of the present disclosure.
Figure 1D:
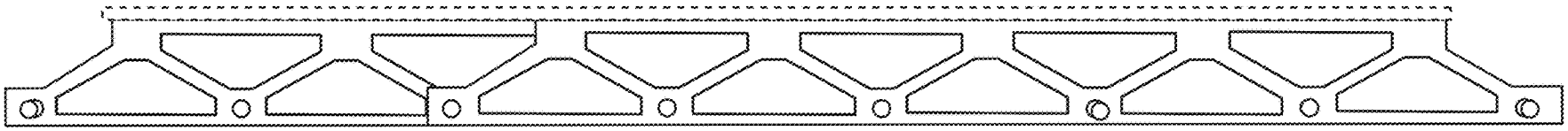
FIG. 1D illustrates a side view of the embed apparatus, in accordance with one or more embodiments of the present disclosure.
Figure 1E:
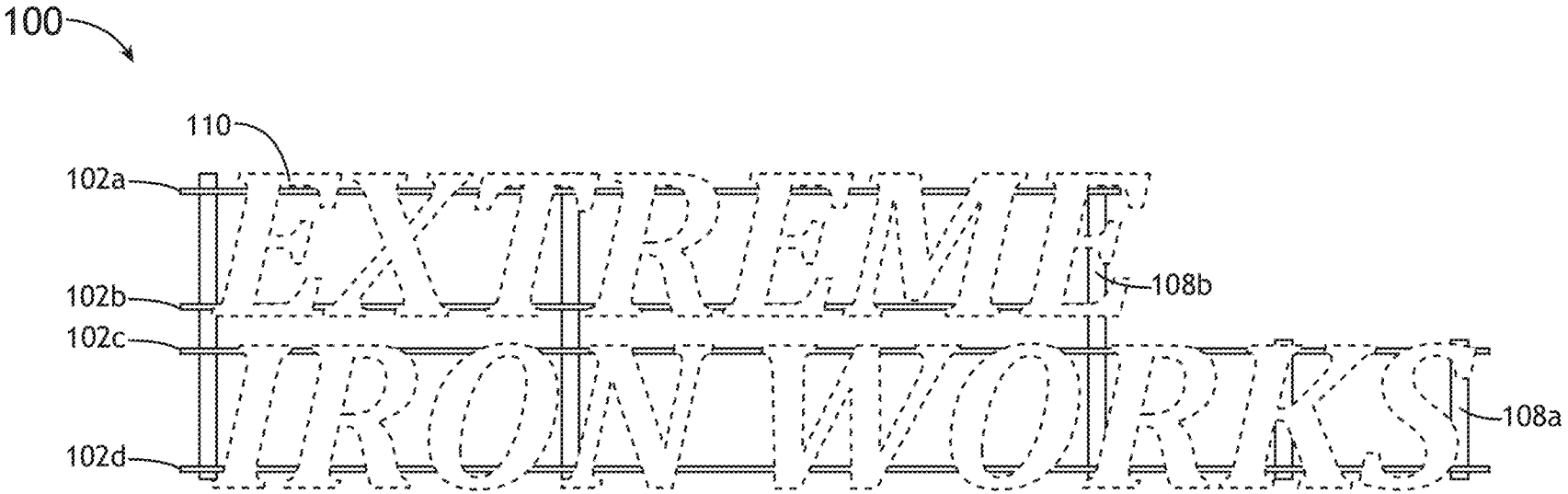
FIG. 1E illustrates a top view of the embed apparatus, in accordance with one or more embodiments of the present disclosure.
Figure 1F:
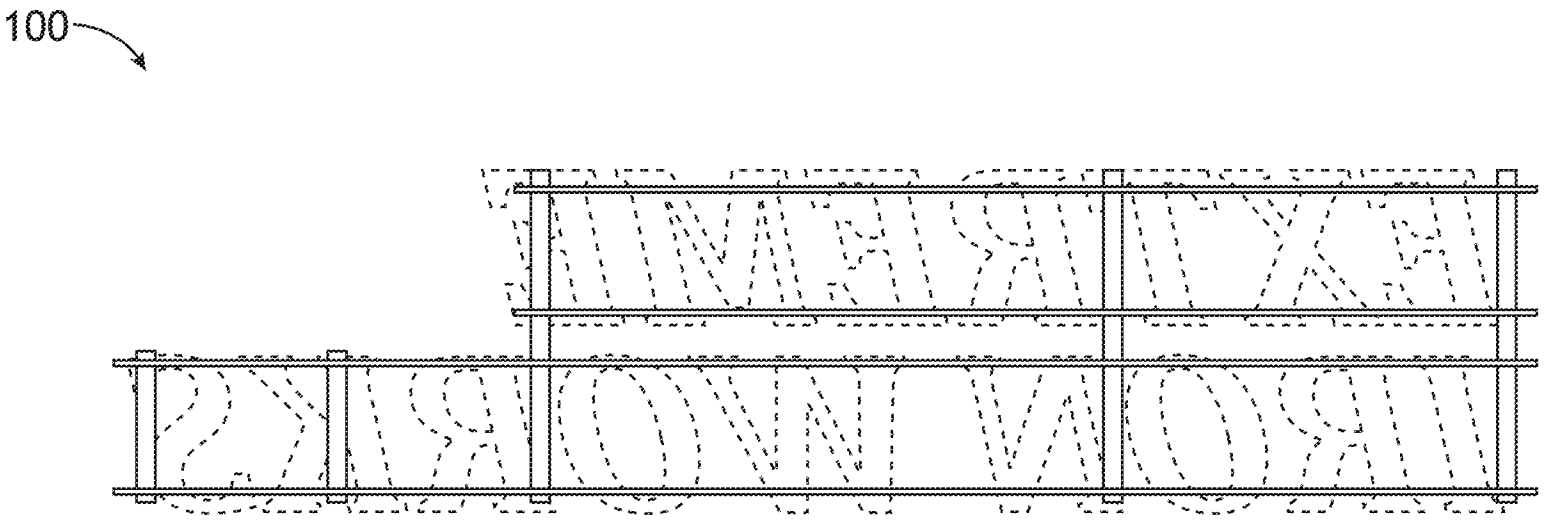
FIG. 1F illustrates a bottom view of the embed apparatus, in accordance with one or more embodiments of the present disclosure.
Figure 1G:
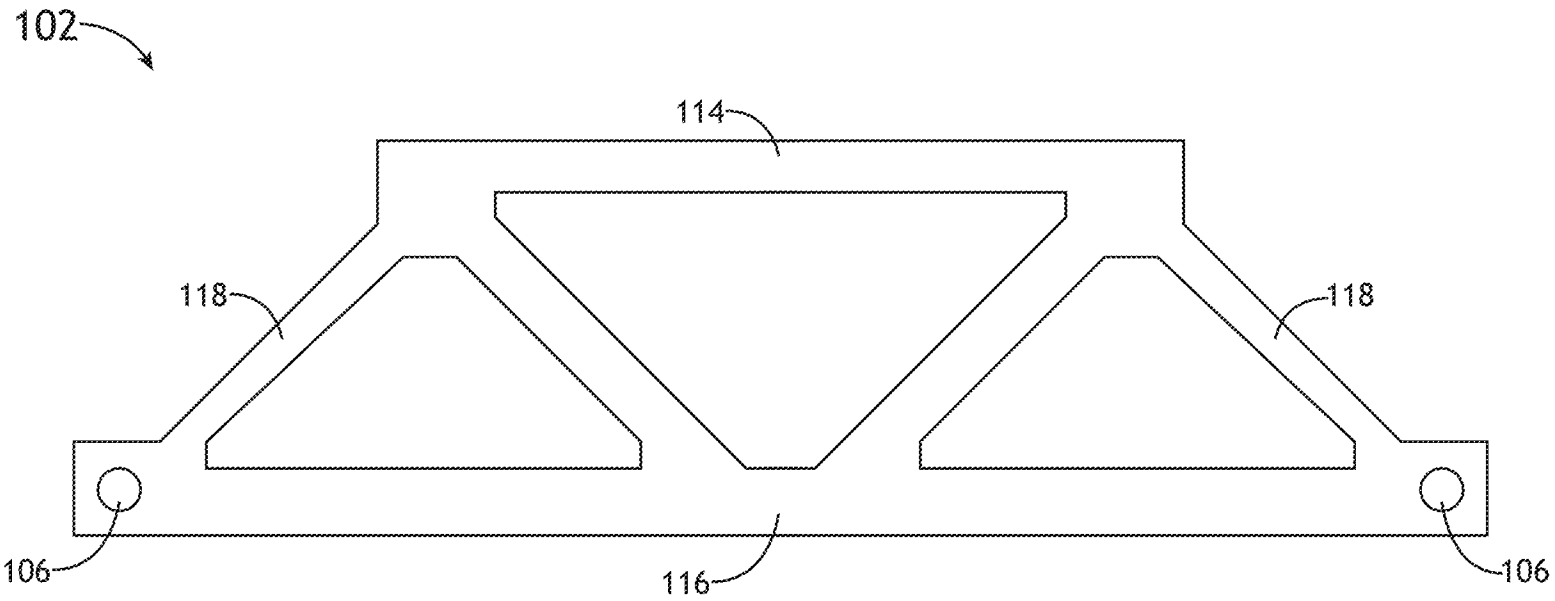
FIG. 1G illustrates a side view of a frame of the embed apparatus, in accordance with one or more embodiments of the present disclosure.

In some embodiments, the frame 102 is formed as a truss with an upper frame 114, a lower frame 116, and one or truss members 118. It is noted herein that the frame 102 may include any truss design known in the art. For example, such truss may have, but is not limited to, a rectangular prism shape (e.g., the truss has a square or rectangular cross-section when viewed from the end of the frame 102 as depicted in FIG. 1B), a triangular prism shape (e.g., the truss has a triangle cross-section when viewed from the end of the frame 102), or any N sided design (e.g., the truss has an N-side cross-section when viewed from the end of the frame 102). By way of another example, the frame 102 may be constructed from one or more curved structures. For instance, at least a portion of the one or more curved structures (i.e., parabolic structures or bow structures) may be arranged in a substantially vertical direction (i.e., 90 degrees from ground), a substantially horizontal direction (e.g. 0 degrees from ground), or at a selected angle from the ground (e.g., angle ranging from 1 to 89 degrees from ground).

The depiction of truss members (e.g., truss member 118) is not intended to be limited to the specific configuration disclosed herein. Rather, the truss members may be in any suitable configuration to support the graphic element 110 and resist tensile and compressive forces (e.g., due to a weight on the graphic element). In this regard, the truss member configuration may include, but is not limited to, a Pratt Truss, a Warrant Truss, or an X member Truss. By way of another example, the truss members may be formed from shapes, such as, but is not limited to, a triangle, a square, a pentagon, a hexagon, a "K shape", or the like.

For the purposes of the present disclosure, the truss members 118 may be fabricated using any fabrication process known in the art. For example, the truss members 118 may be formed via one or more subsequent fabrication processes including, but not limited to, using laser cutting, hand cutting, CNC milling, or the like. By way of another example, the truss members 118 may be formed from one or more concurrent fabrication processes including, but not limited to, casting, molding, or the like.

In some embodiments, the apparatus 100 may further include one or more struts 108 disposed between the one or more frames 102. The struts 108 may be attached to the frame 102 by a portion of the frame 102 which is configured to receive the strut 108 (e.g., a hole 106). The use of strut 108 is used to provide spacing between two or more frames 102. In this regard, the strut 108 may provide compressive and/or tensile force to the frames 102, thereby restricting movement of the frames 108 along the strut 108. The use of such struts 108 may create enhanced rigidity in the apparatus 100. It is noted herein that the strut 108 may be fabricated from a material including, but not limited to, metal, a composite fiber, or the like. For example, the strut 108 may be a bar stock metal or rebar.

As illustrated by FIG. 1B, the apparatus may include a plurality of frames 102*a*, 102*b*, 102*c*, 102*d*, supported by a plurality of struts 108*a*, 108*b*. The struts 108*a*, 108*b* may be of varying length, according to number of frames 102 to which the strut 108 must attach. In this regard, strut 108*a* is shorter than strut 108*b* because 108*a* attaches to frames 102*a*, 102*b*, while strut 108*b* attaches to frames 102*a*, 102*b*, 102*c*, and 102*d*. The number and recitation of strut 108*a* and 108*b* is not intended as a limitation on the present disclosure but rather to highlight that the length of strut 108 may vary depending on the number of attached frames 102. The length of each frame 102 may correspond to the size of the graphic element 110 or may be uniformly sized.

In some embodiments, the strut 108 is configured to attach to the frame 102 by one or more holes 106 (or other receiving structure). The hole 106 may be configured to receive a portion of the strut 108 for coupling the frame 102 to one or more additional frames 102. The one or more struts 108 may be affixed to the one or more holes 106 using any technique known in the art. For example, the one or more struts 108 may be welded, brazed, soldered, or the like to one or more holes 106 on the frame 102.

In some embodiments, the holes 106 may be round holes with a diameter corresponding to a round bar strut. For example, the frame 102 may include one or more holes 106 of suitable diameter for receiving the strut 108. By way of another example, the hole may have a receiving structure of any suitable geometry, such as, but not limited to, a slot, a lip, a square hole, or a recess. In this regard, the frame 102 may receive the strut 108 for ease of assembly (e.g., insertion of the strut 108 within the receiving structure and subsequently welding the strut 108 to the frame 102).

In some embodiments, the hole 106 may be may be formed by a portion of the frame 102 (e.g., one or more of the upper frame 114, lower frame 116, and/or the truss member 118). Although the hole 106 may be formed by a portion of the frame 102, this is not intended as a limitation on the present disclosure. For example, the hole 106 may be attached to the frame 102 by a subsequent process (e.g., welding).

In some embodiments, hole 106 is disposed between the lower frame 116 and the truss members 118 (as depicted in FIGS. 1A-1F). Although the hole has been discussed as being disposed between the lower frame 116 and the truss member 118, this is not intended as a limitation on the present disclosure. For example, the hole 106 may be disposed on any portion of the frame 102, such as, but not limited to, between the upper frame 114 and the truss members 118, attached directly to the lower frame 116, attached directly to the upper frame 114, or disposed on one of the truss members 118. In this regard, a plurality of the holes 106 may be selectively spaced for receiving a plurality of struts 108. The distance between the holes 106 may be selectively determined based on considerations such as, but not limited to, weight of the apparatus 100 and a desired rigidity between the frames 102 (e.g., a greater number of holes may allow for a greater number of struts, resulting in increased rigidity).

In some embodiments, the frame 102 (including upper frame 114, lower frame 116, and truss members 118) and/or the graphic element 110 may be formed from a plate. The plate may have a nominal thickness such as, but is not limited to, from 7 gauge to 30 gauge. Furthermore, the plate may comprise any suitable material for being embedded in concrete, such as, but not limited to, steel (e.g., low-carbon steel, medium-carbon steel, high-carbon steel), a steel alloy (e.g., steel with chromium, cobalt, molybdenum, nickel, niobium, titanium, tungsten, vanadium, and/or zirconium, etc.), alternative metals (e.g., aluminum), a plastic (e.g., polyvinyl chloride (PVC)), or a composite material. The plate may be treated by any suitable process including, but not limited to, hot rolling, cold rolling, galvanization, or heat treating. Such material may be selected for properties such as, but not limited to ability to resist corrosion within concrete, ease of manufacturing, ability to be cut (e.g., by laser, waterjet, plasma, etc.), ability to be welded, cost, or material strength. In this regard, the material selected is not intended as a limitation of the present disclosure.

Although embodiments of the present disclosure are directed to the use of one or more struts 108, it is noted herein that the one or more holes 106 of the frame 102 may be configured to receive and/or couple to rebar (e.g., metal rebar or composite rebar) embedded within the surface of the ground. For example, some or all of the one or more struts 108 may be replaced with rebar. In this regard, the one or more connecting members 108 may not be integrated or required. Therefore, the above description should not be interpreted as a limitation on the present disclosure but merely an illustration. In this example, the rebar may include any bar size known in the art, such as, but not limited to, bar with a diameter ranging from 0.25 inches to 2.25 inches (e.g., imperial bar size 2 through 18). In cases where rebar is used in place of strut 108, such rebar may be used with tied rebar cages.

In some embodiments, the graphic element 110 may include one or more beveled edges. In this regard, the beveled edges of the graphic element 110 may improve with retaining the apparatus by the concrete (e.g., due to an improved adhesion between the beveled edge and the concrete). In this regard, the bevel may be slanted from a top or bottom surface of the graphic element 110. Such bevel may be formed during one or more processes described herein (e.g., during a plasma cutting of the graphic element). Alternatively, the bevel may be formed by one or more post processes, such as, but not limited to, punching, grinding, cutting, or milling. The bevel may be any suitable angle for retaining the graphic element 110, such as, but not limited to, 0 to 45 degrees from a side face of the graphic element. In a further embodiment, a top surface of the graphic element 110 may be treated to improve resistance to wear and corrosion. This may be beneficial if the apparatus 100 is deployed in a high-traffic area or an area which uses corrosive chemicals (e.g., road salts). Furthermore, in some embodiments, the graphic element 110 may include one or more display materials (e.g., copper) with one or more desired colors or textures.

In some embodiments, the graphic element 110 may include, but is not limited to, at least one of a letter, a character, a logo, an icon, an emblem, an image, a number, a memorial plaque, or the like.

Figure 1H:
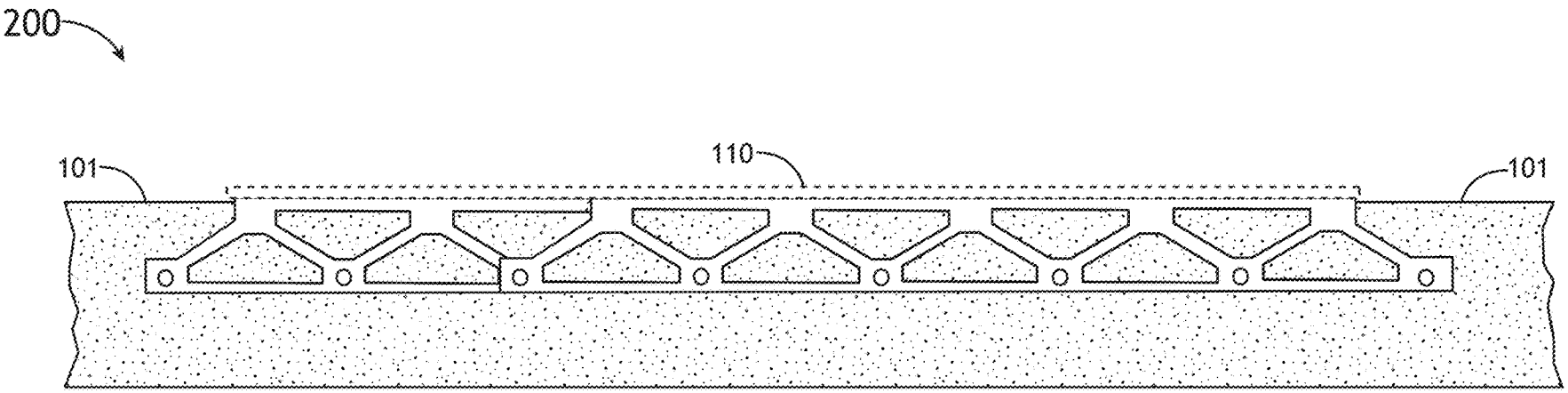
FIG. 1H illustrates a side view of the embed apparatus embedded in a material, in accordance with one or more embodiments of the present disclosure.
Figure 11:
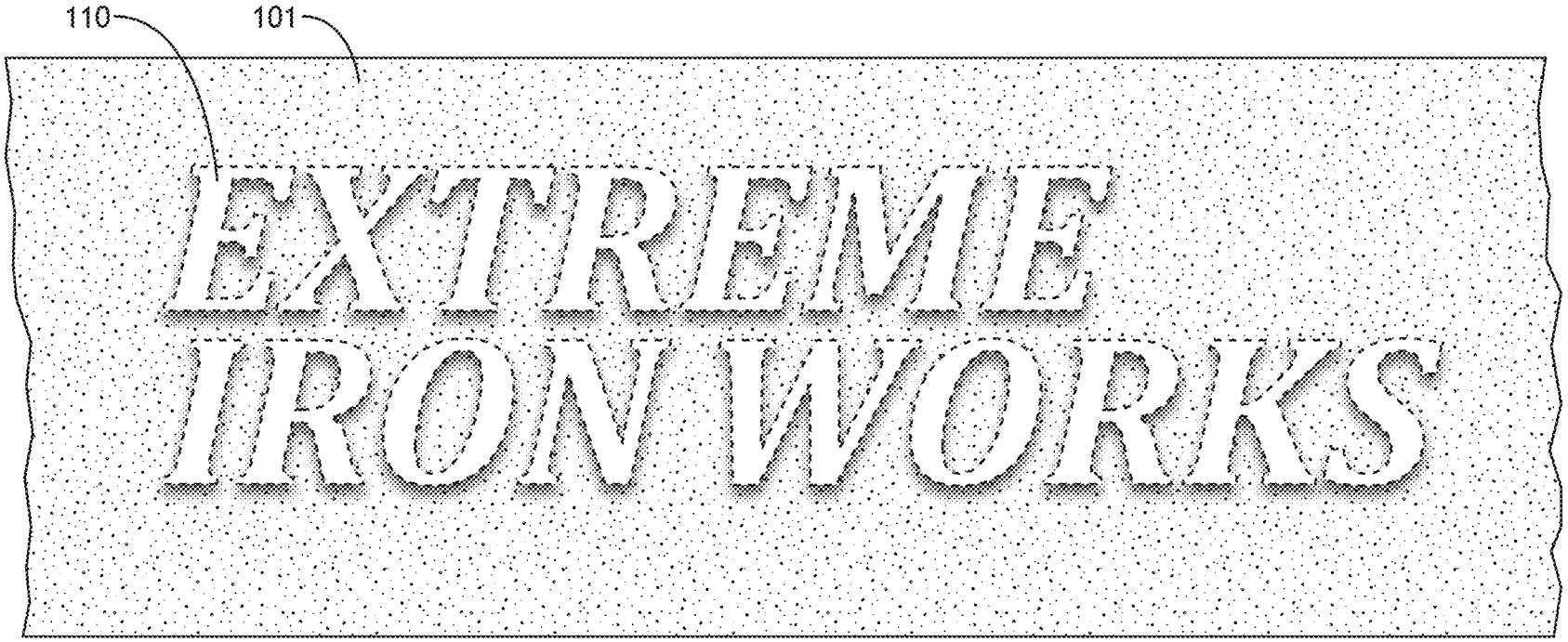

FIGS. 1H and 1I illustrate the apparatus 100 embedded in a volume of material, in accordance with one or more embodiments of the present disclosure.

In one embodiment, the apparatus 100 is configured to be embedded in concrete or other material. The apparatus 100 may include a graphic element 110 coupled to the upper frame 114 such that a face of the one or more graphic elements are positioned at or near ground level 101 (e.g., a paved surface) when the frame 102 is embedded. A bottom face of the lower frame 116 may generally have a flat profile. In this regard, the bottom face of the lower frame 116 may rest on a ground surface (e.g., after a road milling operation but before a paving operation). After pouring the concrete, the graphic element 110 may be generally at the ground level 101 (e.g., a bottom surface of the graphic element 110 may be coplanar with ground level 101; a top surface of the graphic element 110 may be coplanar with ground level 101; or a plane disposed between the top surface and the bottom surface may be coplanar with ground level 101). Alternatively, graphic element 110 may be raised from ground level 101 (e.g., by one inch or more). It is envisioned that the height of the apparatus 100 may be selectively adjusted based on a desired depth of pour and the geometry of the apparatus 100 (e.g., struts 108). In some embodiments, apparatus 100 allows for liquid concrete with varying levels of slump to flow in and around the plurality of truss members 118. In this regard, the position, orientation, geometry, and configuration of the frame 102 and the struts 108 may provide minimal restriction to the flow of said concrete. When surrounded by concrete, the plurality of frames may be configured to secure the graphic element at a top surface of the liquid concrete (e.g., due to a predetermined concrete pour height corresponding to a distance between the graphic element 110 and a bottom surface of the apparatus 100).

Alternatively, in some embodiments, the apparatus 100 may be affected by buoyant forces, such that the bottom face of the lower frame 116 raises from the pre-paved surface as material is poured. In this regard, the graphic element 110 may feature one or more faces which may resist the buoyant forces exerted by the concrete (e.g., a planar flat face).

Referring generally to FIGS. 2A through 2F, an apparatus 200 is shown, in accordance with one or more embodiments of the present disclosure. The apparatus 200 may include frames 202, holes 206, struts 208, graphic element 210, upper frame 214, lower frame 216, and truss members 218. Furthermore, the apparatus 200 may include tabs 212 to attach the graphic element 210 to the frame 202.

It is recognized herein that the frames 202, holes 206, struts 208, graphic element 210, upper frame 214, lower frame 216, and truss members 218 of the apparatus 200 are similar to the frames 102, holes 106, struts 108, graphic element 110, upper frame 114, lower frame 116, and truss members 118 of the apparatus 100. As such, the description of apparatus 100 should be interpreted to extend to apparatus 200, except where otherwise noted.

In one embodiment, the graphic element 210 is attached to the frame 202 by one or more tabs 212. The one or more tabs 212 may extend from the upper frame 214 of the one or more frames 202. In this regard, the tabs 212 may provide an offset between the upper frame 214 and graphic element 210. Such offset may provide selective control of the spacing of the graphic element 210 relative to one or more surfaces (e.g., ground level pre-pour). Additionally, the offset may allow for an improved contact between the apparatus 200 and the material used to retain the apparatus (e.g., concrete). In this regard, the offset between the frame and the graphic element may allow for concrete with varying levels of slump to flow in and around the tabs 212 to retain the graphic element 210.

The tabs 212 may be formed directly onto the frame 202 by one or more processes. In this regard, the tabs 212 and the frame 202 may be cut (e.g., by laser, oxy-fuel, plasma, waterjet, etc.) from a piece of plate steel. However, this is not intended as a limitation on the present disclosure. For example, the tabs 212 may be attached to the frame 202 by a subsequent process, such as, but not limited to, welding or riveting. Such tabs 212 may further assist in selectively controlling the height of the apparatus 200 relative to the depth of pour (e.g., longer tabs may allow for a higher depth of pour).

Referring generally again to FIGS. 1A-2H, an apparatus for embedding in concrete is disclosed.

Figure 2A:
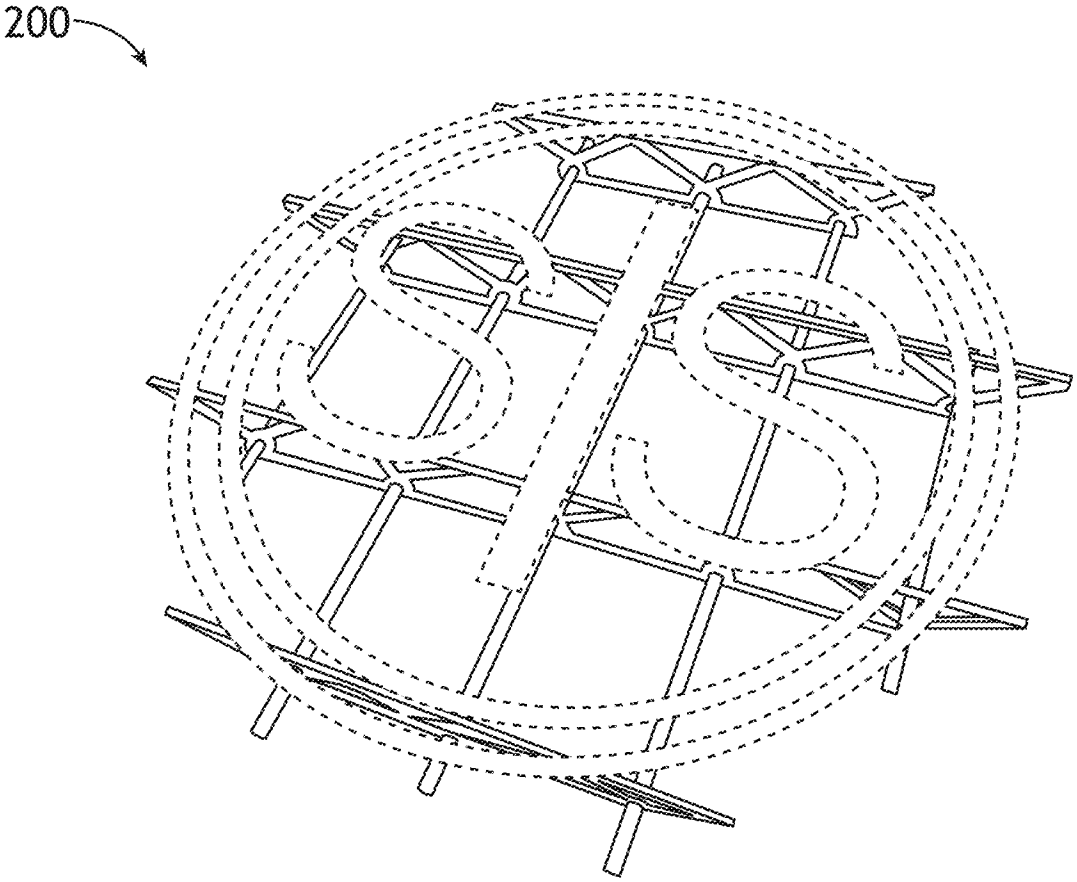
FIG. 2A illustrates a top perspective view of an embed apparatus, in accordance with one or more embodiments of the present disclosure.
Figure 2B:
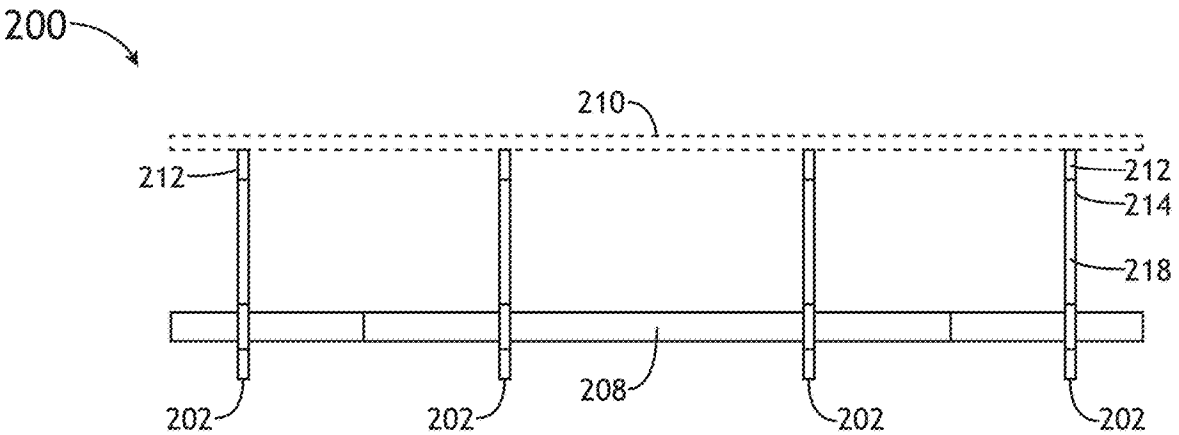
FIG. 2B illustrates an end view of the embed apparatus, in accordance with one or more embodiments of the present disclosure.
Figure 2C:
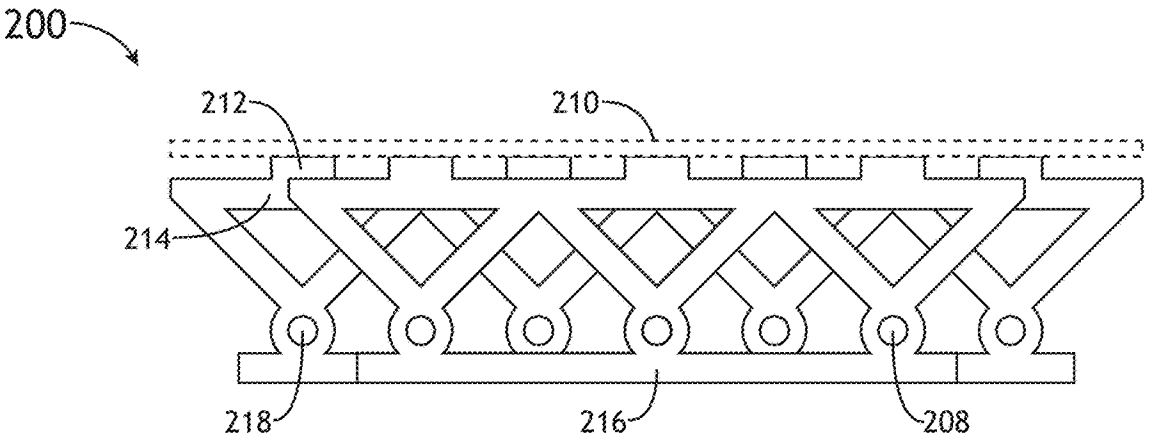
FIG. 2C illustrates a side view of the embed apparatus, in accordance with one or more embodiments of the present disclosure.
Figure 2D:
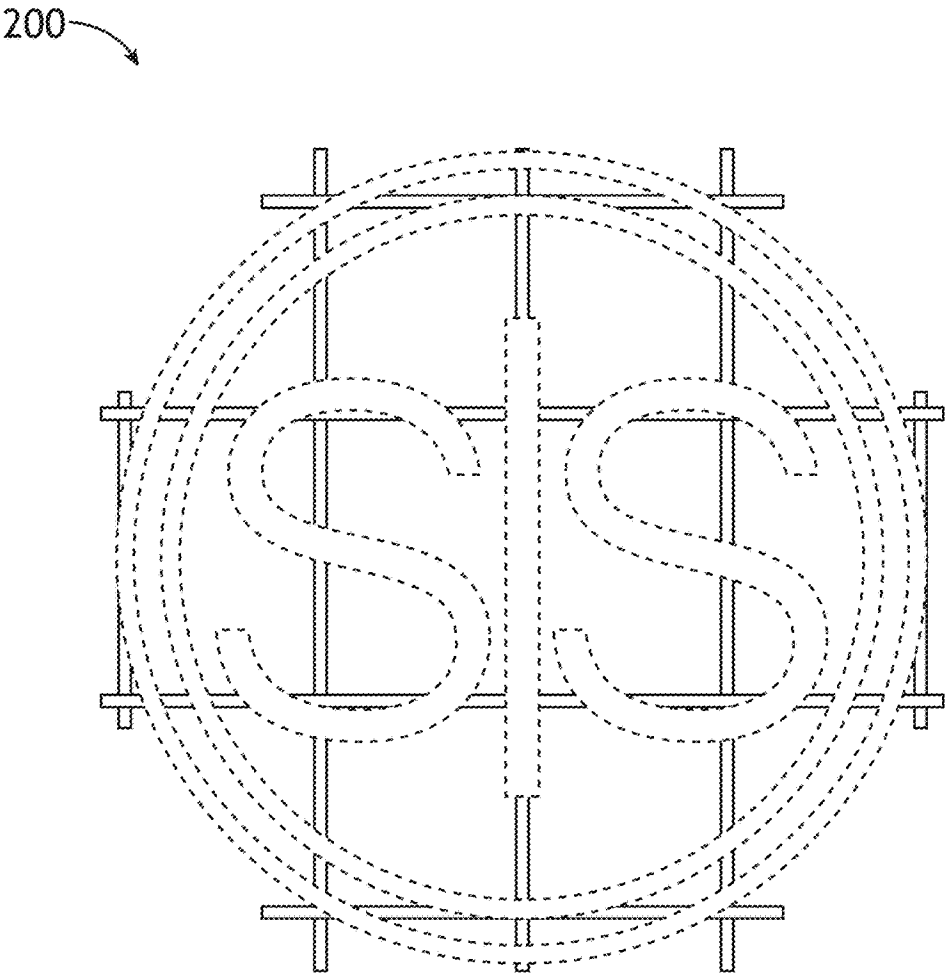
FIG. 2D illustrates a top view of the embed apparatus, in accordance with one or more embodiments of the present disclosure.
Figure 2E:
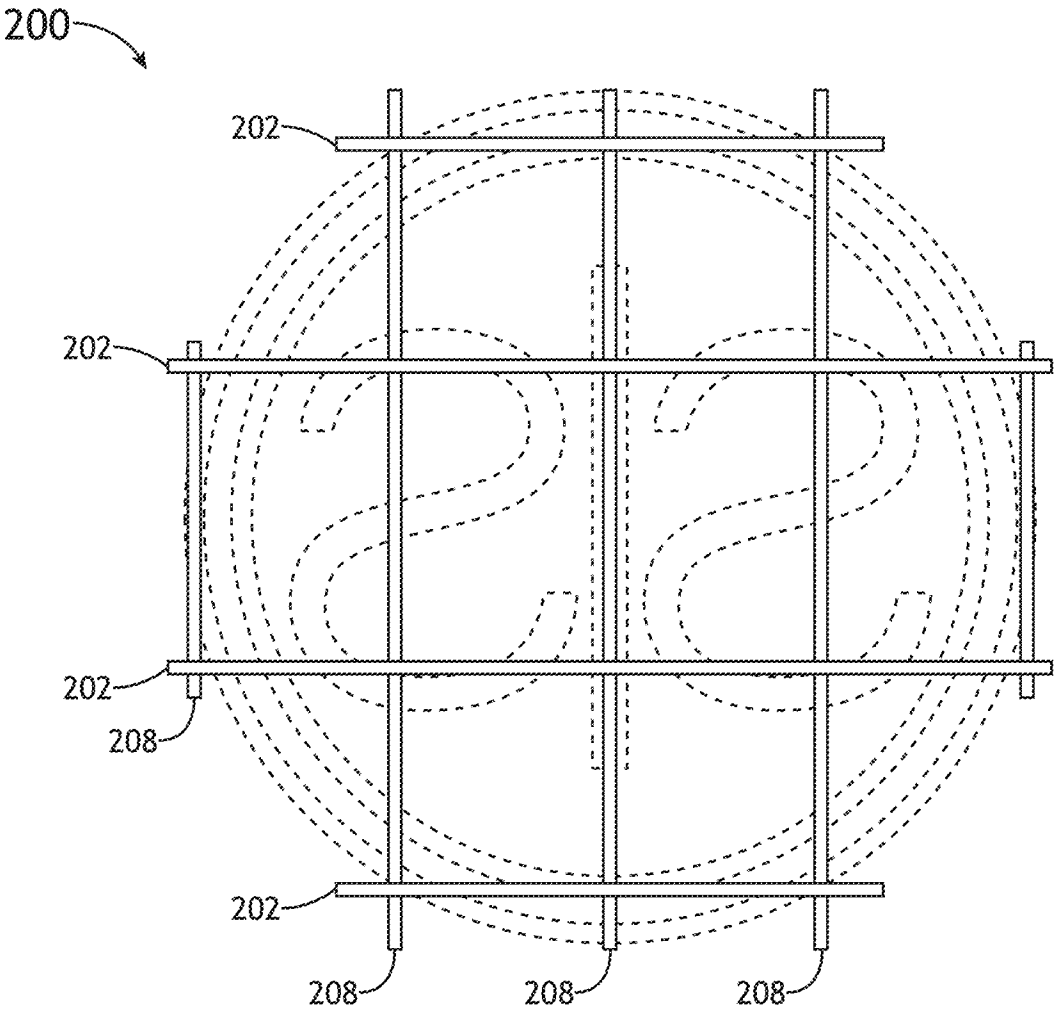
FIG. 2E illustrates a bottom view of the embed apparatus, in accordance with one or more embodiments of the present disclosure.
Figure 2F:
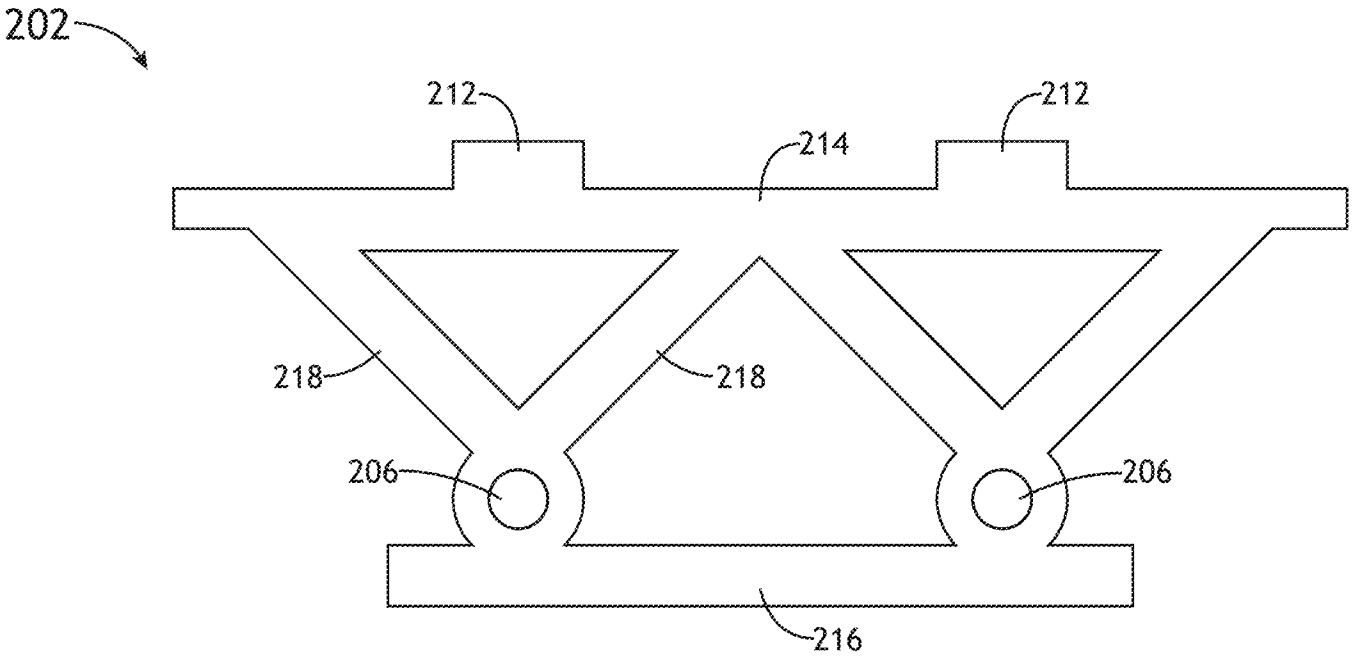
FIG. 2F illustrates a side view of a frame of the embed apparatus, in accordance with one or more embodiments of the present disclosure.
Figure 2G:
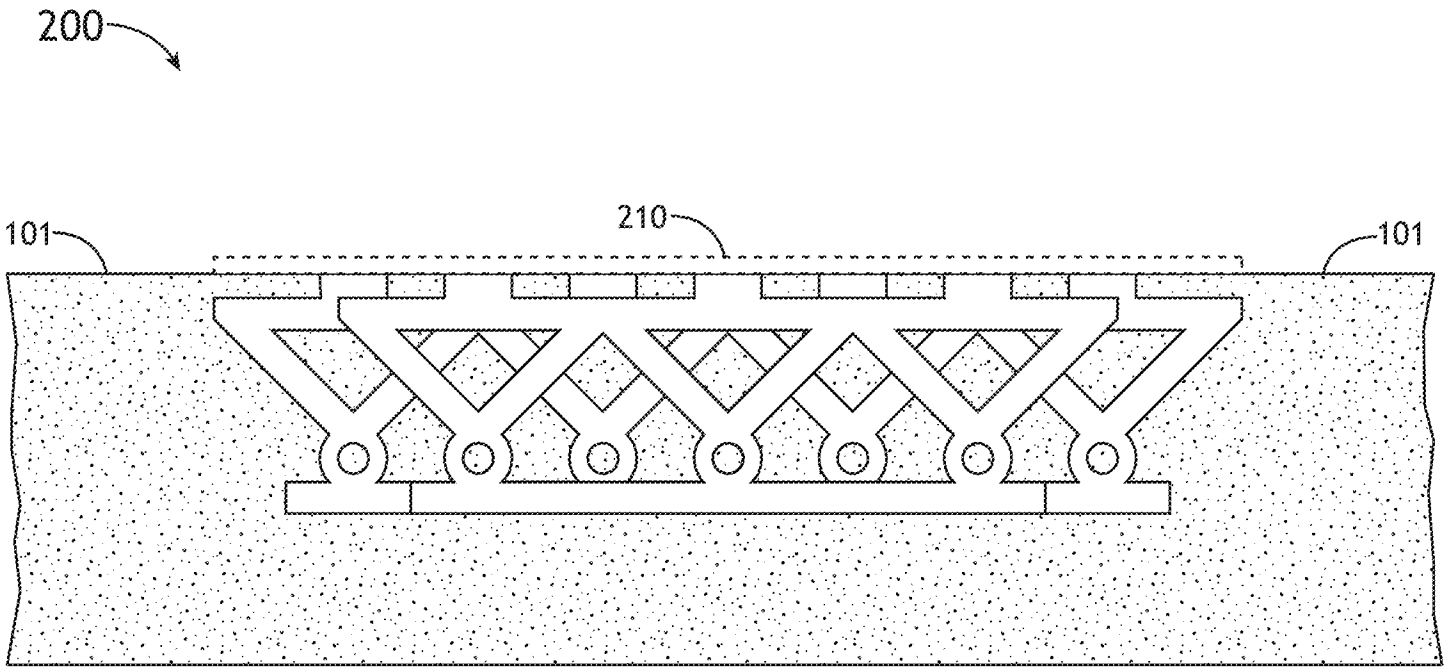
FIG. 2G illustrates a side view of the embed apparatus embedded in a material, in accordance with one or more embodiments of the present disclosure.
Figure 2H:
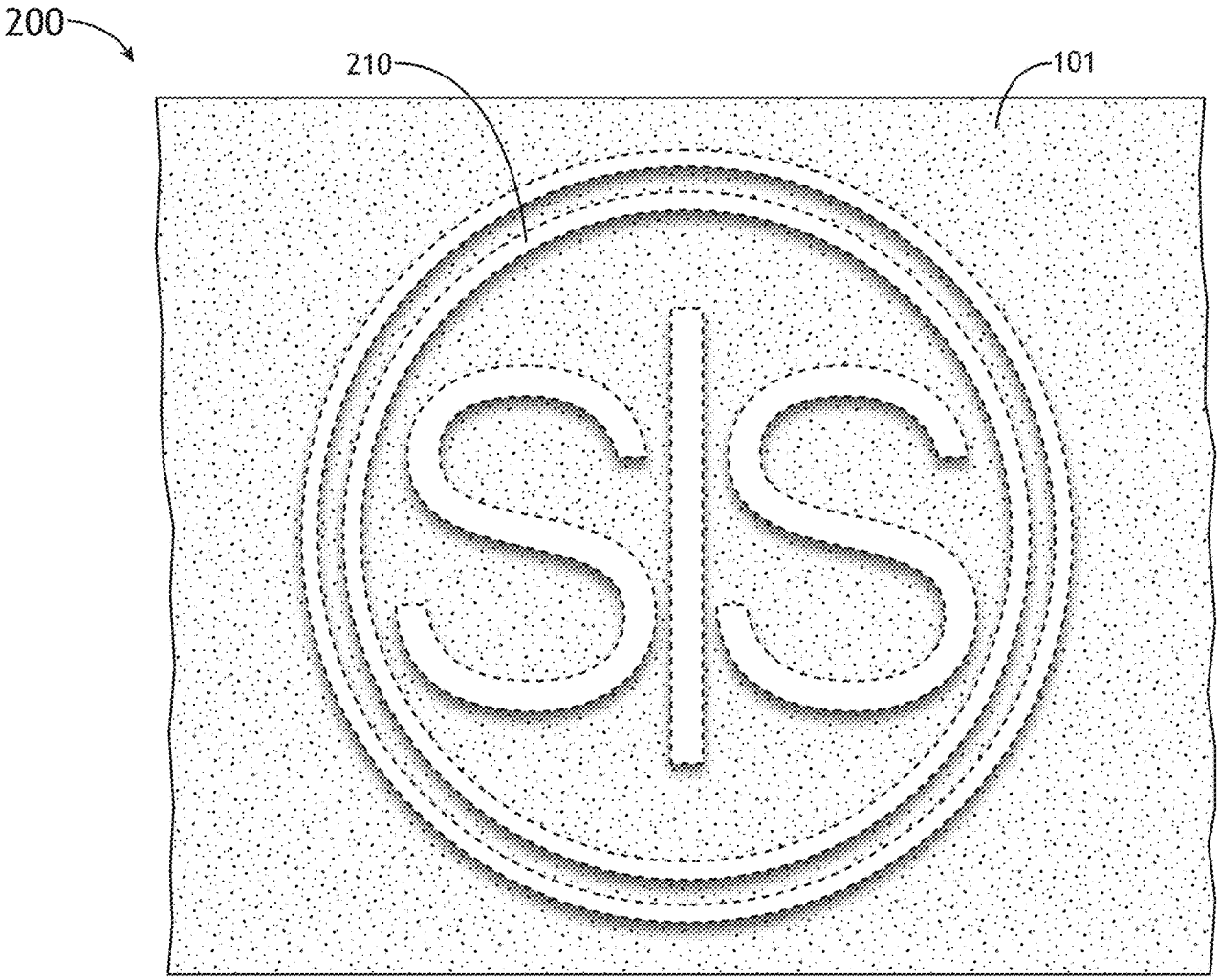
FIG. 2H illustrates a top view of the embed apparatus embedded in a material, in accordance with one or more embodiments of the present disclosure.

In some embodiments, the apparatus (e.g., apparatus 100, or apparatus 200) may include a plurality of frames in parallel, and a plurality of struts orthogonal to the frames (see for example FIG. 2E). This is not intended as a limitation on the present disclosure, unless noted otherwise. For example, a first frame and a second frame may be positioned at a selected angle other than parallel (e.g., 60 to 89 degrees, 91 to 120 degrees, etc.). Similarly, the struts may be positioned at an angle other than orthogonal to the frames. For instance, two non-parallel frames may be positioned at 85 degrees relative to one another (not depicted). In this instance, hole in the non-parallel frames may be angled (not depicted).

In some embodiments, the apparatus (e.g., apparatus 100, or apparatus 200) may include a plurality of frames orthogonal to a ground surface and a plurality of struts parallel to the ground surface. This is not intended as a limitation on the present disclosure, unless noted otherwise. For example, the frames may be a selected angle other than orthogonal (e.g., 60 to 89 degrees, 91 to 120 degrees, etc.). Similarly, the struts may be positioned at an angle other than parallel to the ground. For instance, a tilted frame may be positioned 85 degrees from orthogonal to the ground. In this instance, a hole in the tilted frame may be angled (not depicted).

One skilled in the art will recognize that the herein described components, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, devices, and objects should not be taken as limiting.

Various modifications to the described embodiments will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

In some instances, one or more components may be referred to herein as "configured to," "configurable to," "operable/operative to," "adapted/adaptable," "able to," "conformable/conformed to," etc. Those skilled in the art will recognize that such terms (e.g., "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

Although particular embodiments of this invention have been illustrated, it is apparent that various modifications and embodiments of the invention may be made by those skilled in the art without departing from the scope and spirit of the foregoing disclosure. It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Accordingly, the scope of the invention should be limited only by the claims appended hereto.

What is claimed:

1. An apparatus comprising:

a plurality of frames, each of the plurality of frames including an upper frame portion, a lower frame portion, a plurality of truss members, and a plurality of holes arranged along a horizontal axis of the lower frame portion of the plurality of frames, the plurality of truss members disposed between and attaching the upper frame portion and the lower frame portion, wherein the plurality of frames includes a first pair of frames and a second pair of frames;

a plurality of struts connecting the plurality of frames via the plurality of holes, wherein at least one hole of the plurality of holes of the first pair of frames is aligned with at least one hole of the plurality of holes of the second pair of frames, wherein the plurality of struts include at least one strut configured to attach the first pair of frames and the second pair of frames by inserting the at least one strut through the aligned at least one hole of the first pair of frames and the second pair of frames; and a plurality of graphic elements including at least a first graphic element and a second graphic element, the plurality of graphic elements including at least one of a letter, a planar logo, a number, or a character, wherein the first graphic element is attached to at least the upper frame portion of the first pair of frames and the second graphic element is attached to at least the upper frame portion of the second pair of frames, wherein the plurality of frames are configured to allow liquid concrete to flow around the plurality of truss members, wherein the plurality of graphic elements are configured to allow liquid concrete to flow around one or more side portions of the plurality of graphic elements, wherein the plurality of frames are configured to secure the plurality of graphic elements at a top surface of the liquid concrete, wherein a face of the plurality of graphic elements is positioned at ground level with the top surface of the liquid concrete when the plurality of frames are embedded in the liquid concrete.

2. The apparatus of claim 1, wherein the plurality of graphic elements are attached to at least some of the plurality of frames by a connection with the upper frame portion.

3. The apparatus of claim 2, further comprising one or more tabs integrated with a portion of the upper frame portion of the plurality of frames, wherein the one or more tabs provide the connection between the upper frame portion and the plurality of graphic elements.

4. The apparatus of claim 1, wherein the plurality of struts connects to the plurality of frames by a plurality of holes on the plurality of frames.

5. The apparatus of claim 4, wherein at least some of the plurality of holes are disposed between the plurality of truss members and the lower frame portion.

6. The apparatus of claim 5, wherein the plurality of holes are formed by at least one of the upper frame portion, the lower frame portion, or the plurality of truss members.

7. The apparatus of claim 5, wherein at least some of the plurality of holes are disposed between the plurality of truss members and the upper frame portion.

8. The apparatus of claim 1, wherein a top surface of the plurality of graphic elements are positioned at or above a paved surface when each of the plurality of frames is embedded into a volume of material beneath the paved surface.

9. The apparatus of claim 8, wherein at least some of the plurality of struts are parallel to the pre-paved surface.

10. The apparatus of claim 1, wherein at least some of the plurality of frames are orthogonal to a pre-paved surface.

11. An apparatus comprising:

a plurality of frames, each of the plurality of frames including an upper frame portion, a lower frame portion, a plurality of truss members, and a plurality of holes arranged along a horizontal axis of the lower frame portion of the plurality of frames, the plurality of truss members disposed between and attaching the upper frame portion and the lower frame portion; the upper frame portion including a plurality of tabs integrated with a portion of the upper frame portion of the plurality of frames, each of the plurality of frames including a plurality of holes;

a plurality of struts connecting the plurality of frames via the plurality of holes, wherein at least one hole of the plurality of holes of the first pair of frames is aligned with at least one hole of the plurality of holes of the second pair of frames, wherein the plurality of struts include at least one strut configured to attach the first pair of frames and the second pair of frames by inserting the at least one strut through the aligned at least one hole of the first pair of frames and the second pair of frames; and a plurality of graphic elements including at least a first graphic element and a second graphic element, the first graphic element and the second graphic element including at least one of a letter, a planar logo, a number, or a character, wherein the first graphic element is attached to the first pair of frames and the second graphic element is attached to the second pair of frames, wherein the plurality of frames are configured to allow liquid concrete to flow around the plurality of truss members, wherein the plurality of graphic elements are configured to allow liquid concrete to flow around one or more side portions of the plurality of graphic elements, wherein the plurality of tabs are configured to secure the plurality of graphic elements at a top surface of the liquid concrete, wherein a face of the plurality of graphic elements is positioned at ground level with the top surface of the liquid concrete when the plurality of frames are embedded in the liquid concrete.

12. The apparatus of claim 11, wherein the plurality of holes are formed by at least one of the upper frame portion, the lower frame portion, or the plurality of truss members.

13. The apparatus of claim 12, wherein the plurality of holes are disposed between and formed by the upper frame portion and the plurality of truss members.

14. The apparatus of claim 12, wherein the plurality of holes are disposed between and formed by the lower frame portion and the plurality of truss members.

15. The apparatus of claim 11, wherein the plurality of graphic elements are attached to the plurality of tabs by welding.

16. The apparatus of claim 11, wherein the plurality of graphic elements includes one or more beveled edges.

* * * * *